US006935058B2

(12) United States Patent
Sadegh et al.

(10) Patent No.: US 6,935,058 B2
(45) Date of Patent: Aug. 30, 2005

(54) AUTOMATIC PAGE TURNER WITH BELT DRIVE ELEMENT

(75) Inventors: Ali Sadegh, Franklin Lakes, NJ (US); George Wolberg, Woodmere, NY (US)

(73) Assignee: PageFlip, Inc., Woodmere, NY (US)

( * ) Notice: Subject to any disclaimer, the term of this patent is extended or adjusted under 35 U.S.C. 154(b) by 0 days.

(21) Appl. No.: 10/732,855

(22) Filed: Dec. 9, 2003

(65) Prior Publication Data

US 2005/0120601 A1 Jun. 9, 2005

(51) Int. Cl.[7] ..... G09F 19/00; G10G 7/00
(52) U.S. Cl. ..... 40/531; 84/487; 40/470
(58) Field of Search ..... 40/343, 531, 470, 40/475, 466; 84/487, 493, 502–507

(56) References Cited

U.S. PATENT DOCUMENTS

| | | | | |
|---|---|---|---|---|
| 4,040,195 A | | 8/1977 | Claypool et al. | 40/341 |
| 4,160,334 A | | 7/1979 | Willis | 40/531 |
| 4,432,154 A | * | 2/1984 | D'Arcy | 40/531 |
| 4,644,675 A | | 2/1987 | Berger et al. | 40/531 |
| 4,685,375 A | * | 8/1987 | Ross et al. | 86/20.15 |
| 4,719,712 A | | 1/1988 | Moreau et al. | 40/475 |
| 5,203,248 A | | 4/1993 | Carr et al. | 84/487 |
| 5,233,900 A | | 8/1993 | Fitzgerald | 84/497 |
| 5,373,772 A | | 12/1994 | Shemoul | 84/486 |
| 5,493,943 A | | 2/1996 | Horikawa | 84/519 |
| 5,575,097 A | | 11/1996 | Chou et al. | 40/531 |
| 5,962,801 A | | 10/1999 | Bowman et al. | 84/486 |
| 6,049,033 A | | 4/2000 | Dallas | 84/486 |
| 6,107,558 A | | 8/2000 | Cowan | 84/488 |
| 6,215,058 B1 | | 4/2001 | Molchak et al. | 84/486 |

* cited by examiner

*Primary Examiner*—Cassandra Davis
(74) *Attorney, Agent, or Firm*—Sheldon & Mak; Robert J. Rose; Marc Karish

(57) ABSTRACT

An apparatus for turning bound pages, the apparatus having a frame; a book support assembly coupled to the frame; at least one pickup arm coupled to the frame; a motor assembly coupled to the frame; and a conveyor assembly coupled to the frame. The conveyor assembly has a belt; a plurality of fingers coupled to the belt; and at least one actuator coupled to the belt. A subset of the plurality of fingers hold the book in an open condition. Upon rotation of the belt by the motor assembly, the at least one actuator causes the at least one pickup arm to lift a portion of a page while a subset of the plurality of fingers hold the bound pages in an open condition and turn the lifted page.

14 Claims, 12 Drawing Sheets

AUTOMATIC PAGE TURNER WITH BELT DRIVE ELEMENT

BACKGROUND

The present invention relates to a compact page turning device suitable for turning bound pages.

Page turning is an important ancillary process of reading. It is a pervasive task that many people take for granted. An automatic page turner can assist people with disabilities and the elderly, who may have limited upper extremity function. A page turner can also furnish hands-free operation to musicians, and provide avid readers with convenient book support and page turning features.

While there are many patents on the subject of automatic page turners, virtually none of them have led to successful working products. This is due to the fact that all of the patents lack one or two of the three major functions of a successful page turner: engagement with the page, transport of the page, and restraining the book pages to lie flat. A review of the patents identifies several design flaws, including unreliable and noisy mechanisms for engaging one page at a time, and cumbersome preprocessing whereby clips or tabs must be attached to each page.

Some relevant patents in this area include, U.S. Pat. No. 4,040,195 to Claypool et al.; U.S. Pat. No. 4,160,334 to Willis; U.S. Pat. No. 4,644,675 to Berger et al.; U.S. Pat. No. 4,719,712 to Moreau et al.; U.S. Pat. No. 5,203,248 to Carr et al.; U.S. Pat. No. 5,233,900 to Fitzgerald; U.S. Pat. No. 5,373,772 to Shemoul; U.S. Pat. No. 5,493,943 to Horikawa; U.S. Pat. No. 5,575,097 to Chou et al.; U.S. Pat. No. 5,962,801 to Bowman et al.; U.S. Pat. No. 6,049,033 to Dallas. The present invention seeks to remedy the defects of the prior art.

SUMMARY OF THE INVENTION

The present invention is directed to an apparatus for turning bound pages. In one embodiment of the present invention, the apparatus has a frame; a support assembly coupled to the frame; at least one pickup arm coupled to the frame; a motor assembly coupled to the frame; and a conveyor assembly coupled to the motor assembly. The conveyor assembly has a belt; a plurality of fingers coupled to the belt; and at least one actuator coupled to the belt. A subset of the plurality of fingers holds the bound pages in an open condition. Upon rotation of the belt by the motor assembly, the actuator causes the pickup arm to lift a portion of a page. At least one of the plurality of fingers turns the lifted page while another of the plurality of fingers holds the bound pages in an open condition.

The motor assembly can have a motor; a gear reduction train coupled to the motor; a clutch coupled to the gear reduction train; and a sprocket coupled to the clutch, the sprocket being connectable to the belt. Optionally, the motor is reversible. At least one button can be electrically coupled to the motor for energizing the motor. Optionally, at least one of a foot pedal, a breath-controlled switch, a chin switch, a voice activation device, or a computerized timer is electrically coupled to the motor for energizing the motor.

The support assembly can have two expandable spines, each spine having a proximal end and a distal end. A crossbar support can be mounted on each end of the spine. A clamp can be mounted on each crossbar support by a spring hinge, the spring hinge providing a bias force on the bound pages.

Each spine can be attached to the frame by a mounting bracket. Optionally, the mounting bracket has a frame; a base having two vertical cylindrical cavities, and an angled cylindrical cavity coupled to the proximal end of one of the spines. The mounting bracket can also have a center rod having an inner rod; a spring located coaxially around the center rod; and a plurality of guiding rods located on each side of the center rod, the guiding rods being coupled to the frame and insertable in the two vertical cavities of the base. The base is moveable along the two guiding rods to generate a reaction bias force in the spring.

Optionally, the conveyor assembly further comprises: two right actuators coupled to the belt and two left actuators coupled to the belt. Each finger can have a base; an arm coupled to the base; and a roller coupled to the arm. The actuator can have a base coupled to the belt; a frame coupled to the base; a cam coupled to the frame; and a switch trigger coupled to the base. The switch trigger on the actuator is only rotatable in one direction.

Optionally, the pickup arm can have: a bracket mountable to the frame; a shaft mounted to the bracket; an arm coupled to the shaft, the arm having a proximal end and a distal end, the arm being bent, curved or angled; a roller rotatably coupled to the distal end of the arm, the surface of the roller being covered with an adhesive; a torsional spring coupled to the shaft, the torsional spring applying a bias torque to the arm and thereby maintaining the arm in a neutral position; and a follower pin coupled to the shaft. The follower pin impacts the actuator to rotate the arm and place the roller in contact with the page of the book. Upon release of the follower pin by the actuator, the spring provides a bias torque and lifts the arm. Optionally, the roller could be replaced with a suction means, where a pneumatic negative pressure will lift the page.

The present invention is also directed to a method for turning bound pages comprising: selecting the apparatus of the present invention; placing bound pages in the support assembly; and energizing the motor assembly to turn at least one of the bound pages.

BRIEF DESCRIPTION OF THE DRAWINGS

A better understanding of the present invention will be had with reference to the accompanying drawings in which.

DETAILED DESCRIPTION

Figure 1:
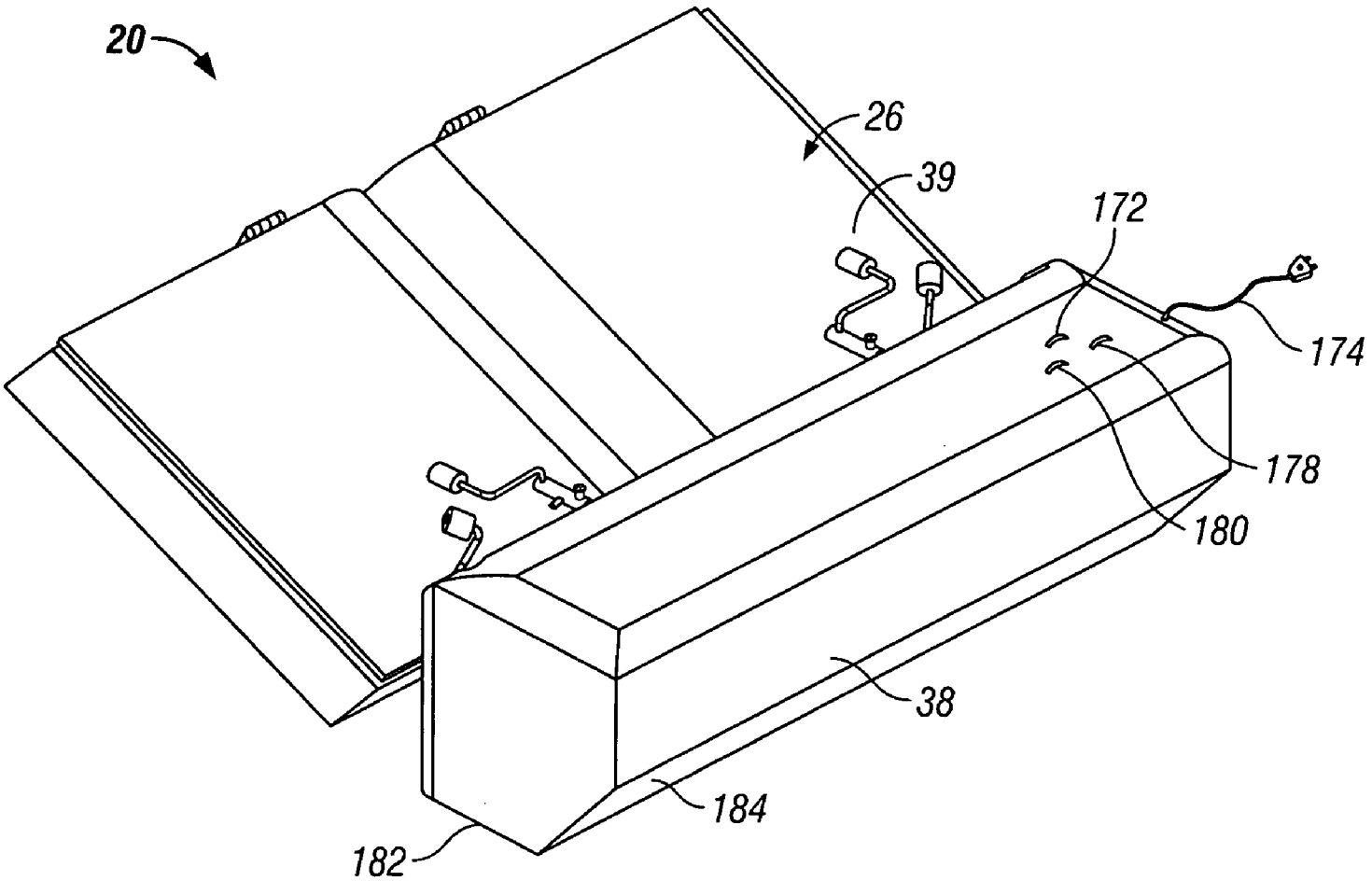
FIG. 1 is a front perspective view of one embodiment of the page turner of the present invention shown with a book.
Figure 2:
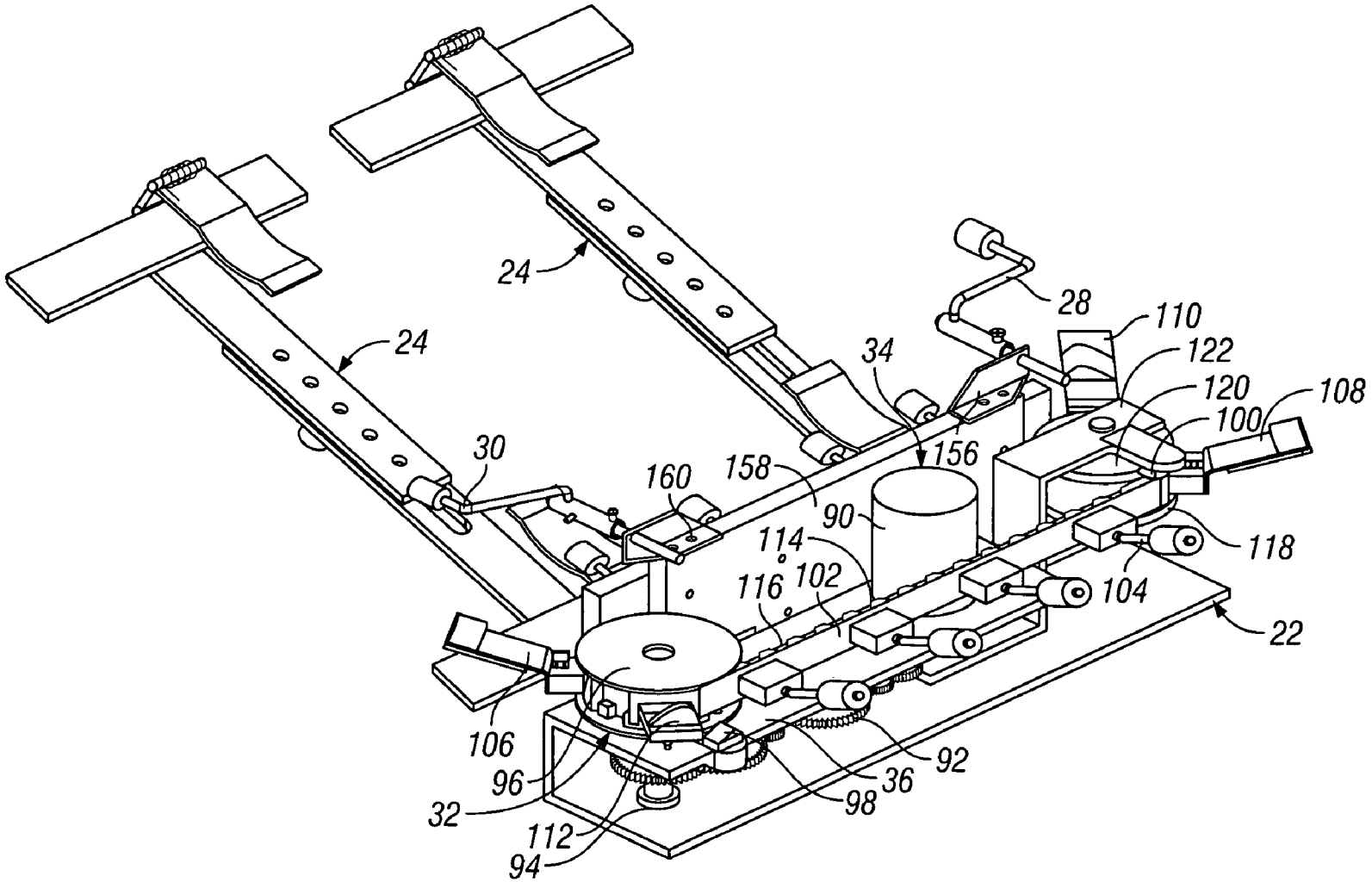
FIG. 2 is a front perspective view of the page turner of FIG. 1, shown without the casing.

As shown in FIGS. 1 and 2, an automatic page turner 20 according to one embodiment of the present invention generally has a frame 22. A book support assembly 24 for holding a book 26 is coupled to the frame 22. Also coupled to the frame 22 is a right pickup arm 28, a left pickup arm 30 and a conveyor assembly 32. A motor assembly 34 is coupled to the frame 22 by a support 36. A cover 38 is coupled to the frame 22 and covers the conveyor assembly 32 and the motor assembly 34. As will be explained below, the conveyor assembly 32, in conjunction with the right pickup arm 28 and the left pickup arm 30, are operated to turn pages 39 of the book 26.

Figure 3:
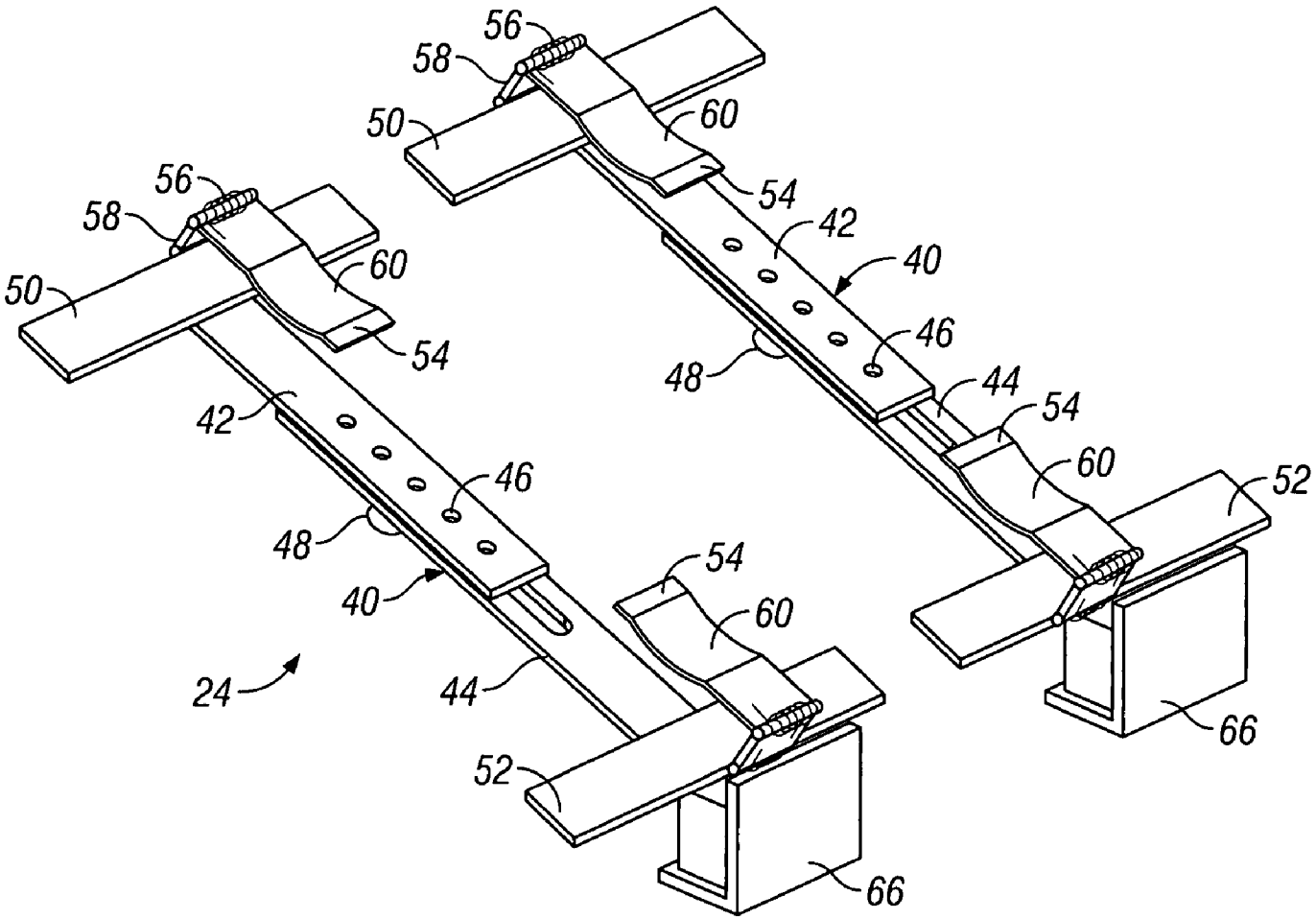
FIG. 3 is a front perspective view of the book support assembly of FIG. 2.

The book support assembly 24 will now be considered in more detail. As shown in FIG. 3, the book support assembly 24 comprises two telescopic spines 40. Each telescopic spine has an upper member 42 and a lower member 44. Optionally, the upper and lower members 42, 44 can slide over one another through a tongue and groove. The upper and lower members 42, 44 can be made of hard materials such as metal or plastic. Optionally, the total height of the spines 40 can be fixed by a series of pinholes 46 and setscrews 48.

An upper crossbar 50 is attached at a distal end of each upper member 42. A lower crossbar 52 is attached to the proximal end of each lower member 44. A clip 54 is connected to each of the upper and lower crossbars 50, 52 through a spring 56 and an adjustable clip support 58. The clip 54 is biased by the spring 56 so as to apply a restraining force on the book pages to keep the book open. In one embodiment, the clip 54 has a contact region 60 that is curved toward the upper member 42 for increasing the contact force between the clip and the book pages.

Figure 4:
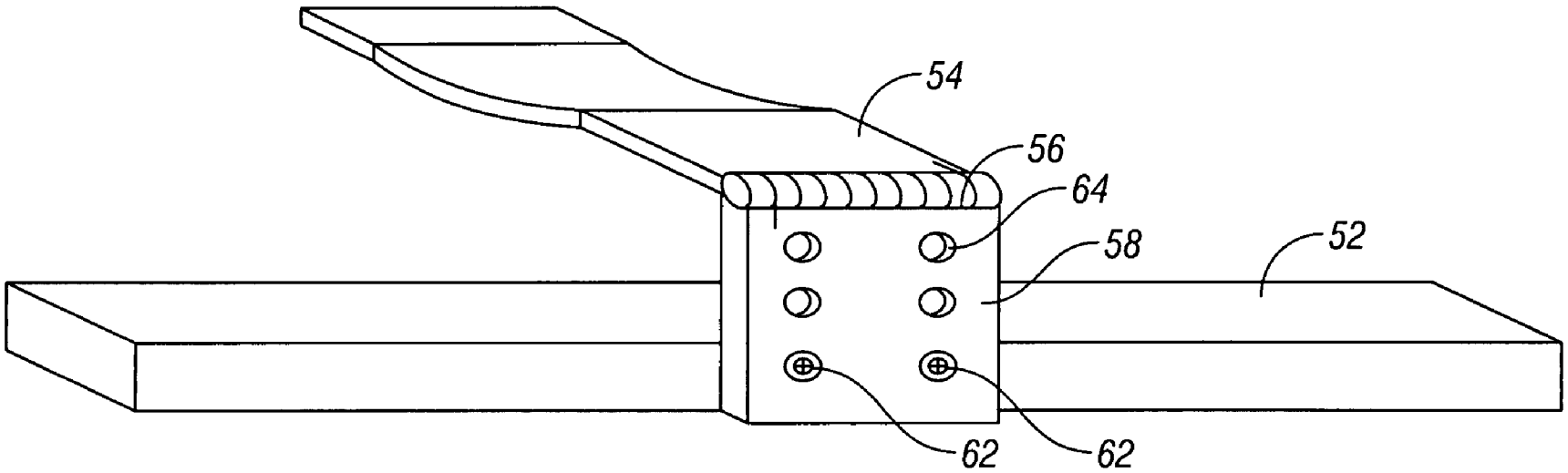
FIG. 4 is a perspective view of one of the crossbar clips of FIG. 3.

As shown in FIG. 4, each clip support 58 is attached to one of the upper or lower crossbars 50, 52 using a pair of pins 62 inserted into a pair of pinholes 64. Depending on the number of pages on each side of the book 26, the height of the clip support 58 is adjusted by using an appropriate set of pinholes 46.

Figure 5:
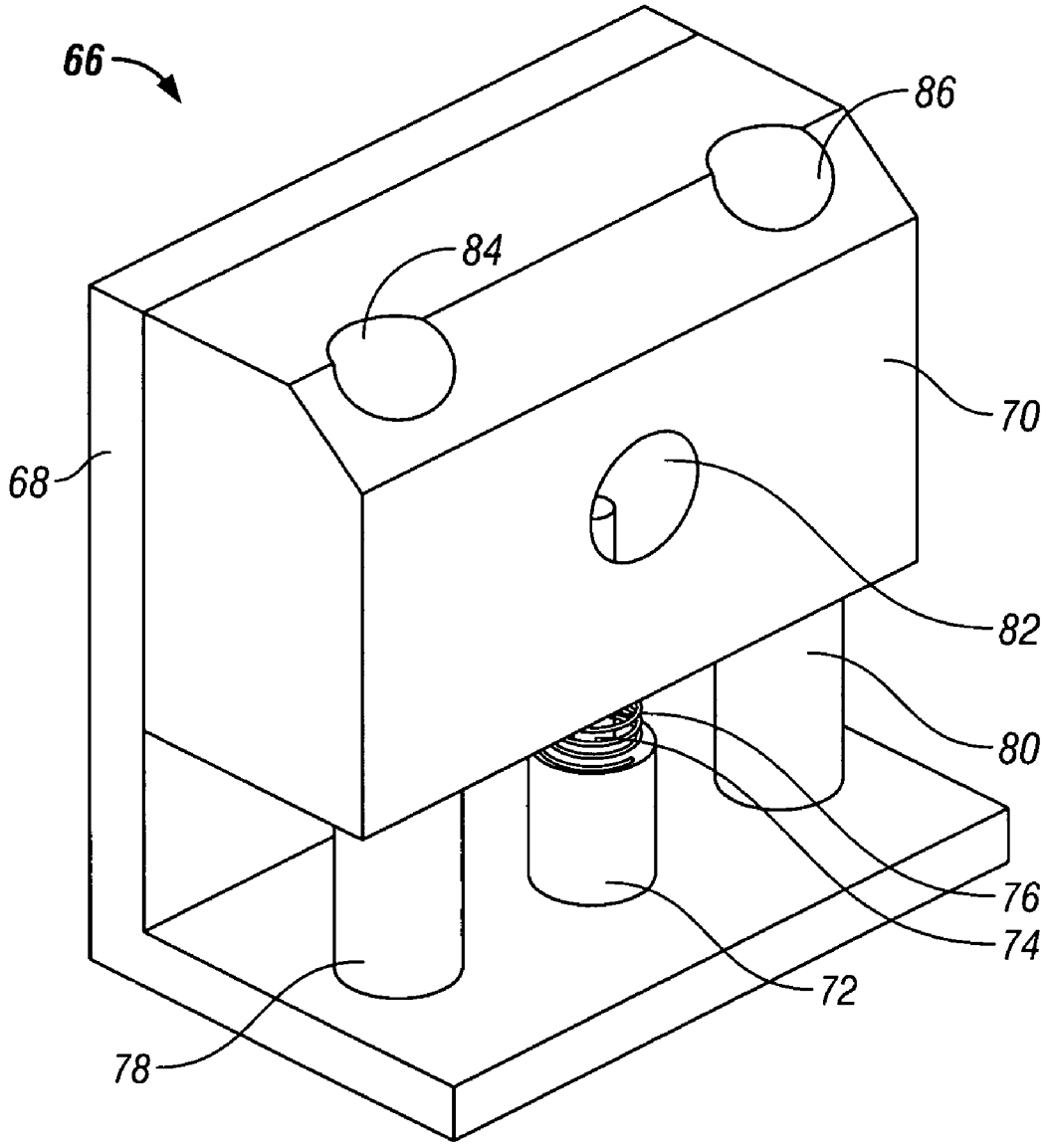
FIG. 5 is a perspective view of one of the book support brackets of FIG. 3.

The lower members 44 of the spines 40 are attached to the frame 22 through two support brackets 66. As shown in FIG. 5, each support bracket 66 has a frame 68, a base 70, and a center tube 72 connecting the base 70 to the frame 68. The center tube 72 has an inner rod 74 and a spring 76 located coaxially around the rod 74. First and second guiding rods 78, 80 also connect the base 70 to the frame 68.

The base 70 has disposed in it a first cylindrical cavity 82 which has an angle of about 60 degrees with respect to a vertical rear plane of the frame 68. The proximal end of the lower member 44 of the spine 40 is rod shaped and is insertable into the first cylindrical cavity 82 of the base 70.

The base 70 also has disposed in it second and third vertically oriented cylindrical cavities 84, 86 into which slide the first and second guiding rods 78, 80. Additionally, the base 70 has disposed in it a fourth vertically oriented cylindrical cavity (not shown) into which slides the inner rod 74. The base 70 can slide downward upon exertion of a downward force against the spring 76. The book support assembly is pushed upward by the spring 76 to ensure a proper orientation of the book with respect to the other arts of the automatic page turner.

Considering the motor assembly 34 in more detail, as shown in FIG. 2, the support 36 coupled to the frame 22 provides bearing support for a motor 90. The motor 90 is coupled to a gear reducer train 92, which is in turn coupled to a clutch 94 and a driver sprocket 96. The motor 90 can be any small conventional electric motor. A right limiting switch 98 and a left limiting switch 100 are rigidly attached to the left and the right side of the support 36, respectively. The limiting switches disconnect the power from the motor 90.

As shown in FIG. 2, the conveyer assembly has a timing belt 102. The timing belt 102 has a series of fingers 104, two left actuators 106, 108, and two right actuators 110, 112. The timing belt 102 has a plurality of teeth 114 and a plurality of depressions 116 located on its interior surface. The timing belt 102 is placed around a sheave 118 of a pulley 120 coupled to the frame 22 by a bracket 122. The timing belt 102 is also placed around the drive sprocket 96 where the timing belt teeth 114 are engaged with a series of teeth (not shown) on the sprocket 96.

Figure 6:
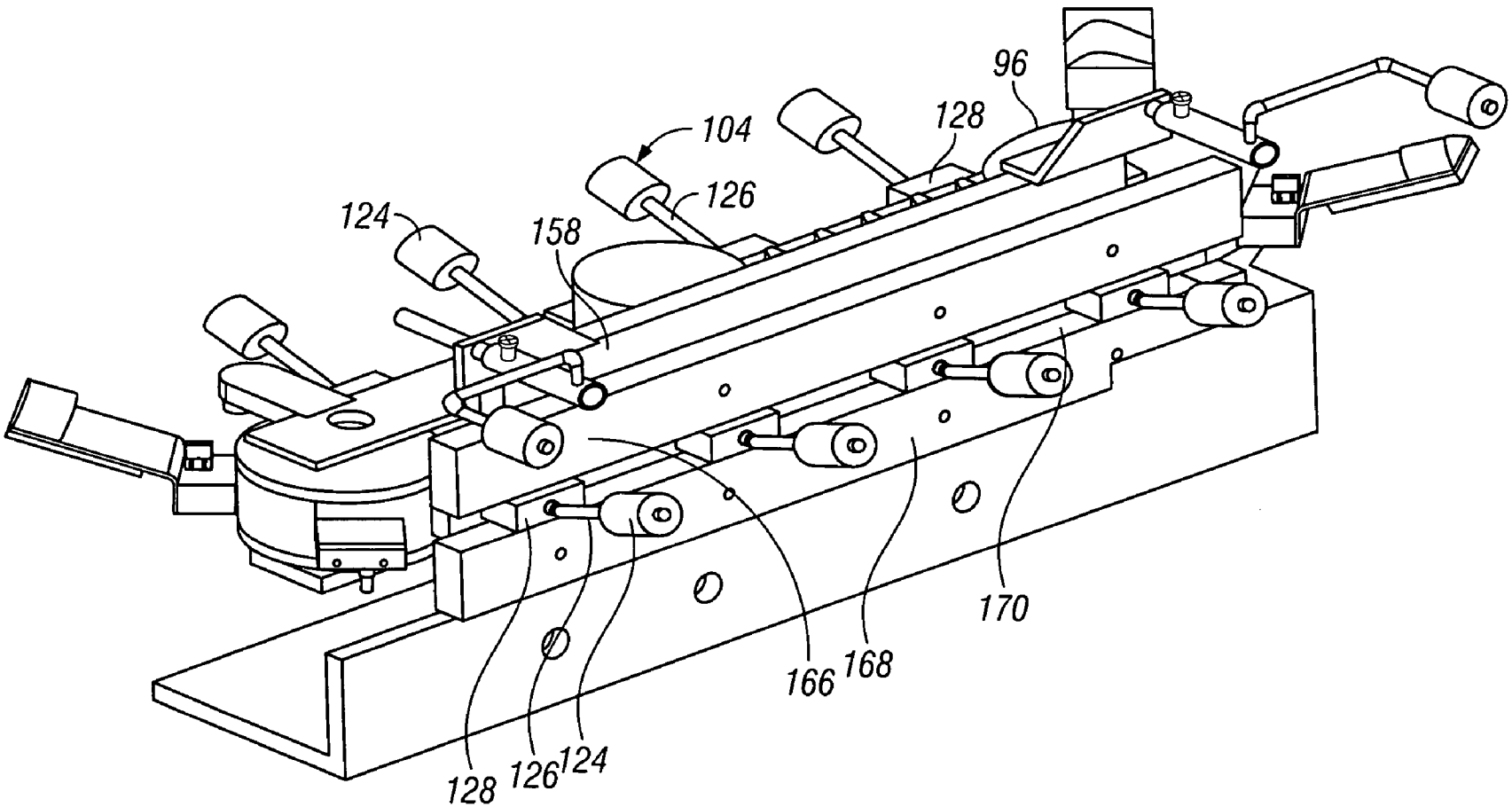
FIG. 6 is a rear perspective view of the page turner of FIG. 1.
Figure 7:
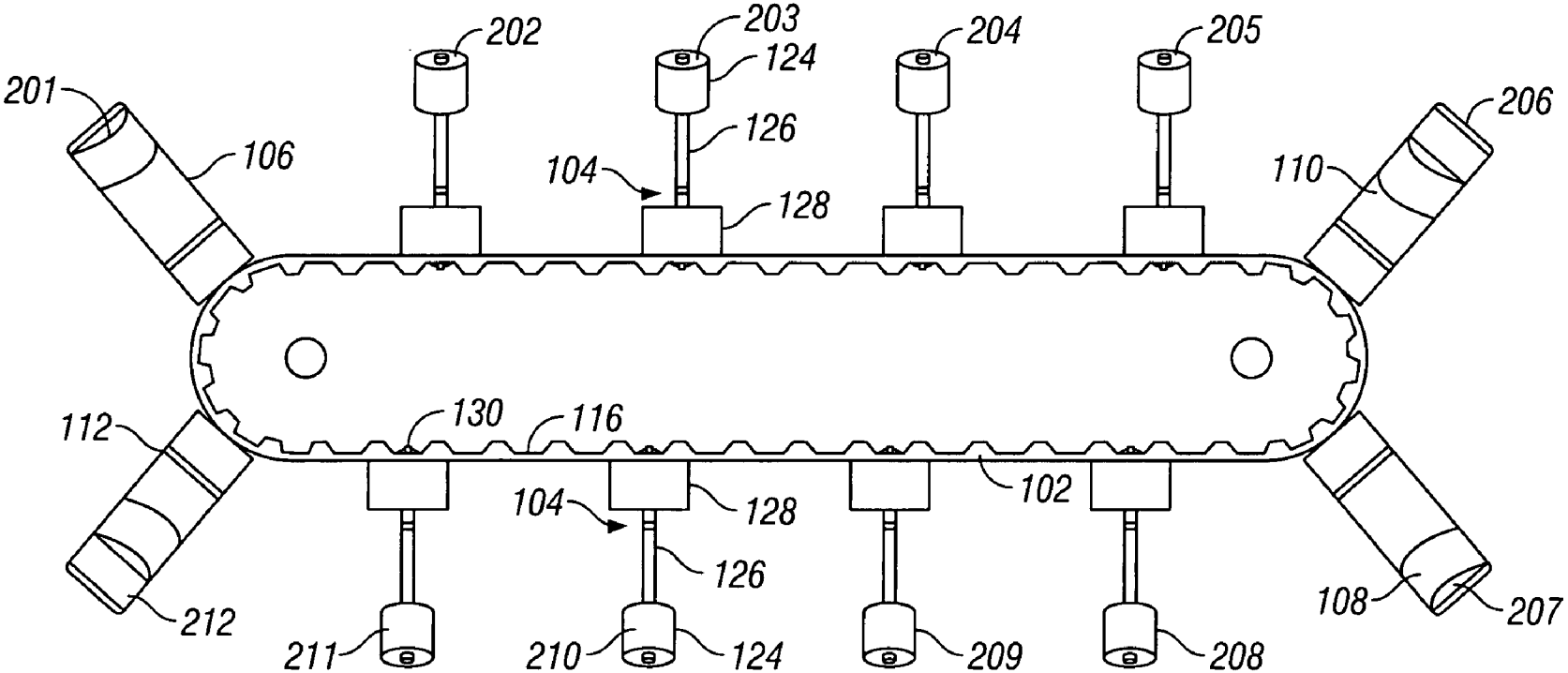
FIG. 7 is a top view of the belt with attached fingers usable with the invention.

As shown in FIGS. 6 and 7, a typical finger 104 has a cylindrical roller 124 that is attached to an arm 126, which is attached to a base 128. Alternatively, a finger 104 may have a flat sliding means (not shown) attached to the arm 126. The base 128 is attached to the timing belt 102 using fasteners known in the art, such as a screw 130. The arm 126 is bent about 60 degrees with respect to the vertical side of the page turner apparatus. The base 128 is attached to the belt 102 so that the head of the screw 130 is located in the middle of one of the depressions 116 of the belt 102. To accommodate the screw head, the teeth of the sprocket 96 have a circumferential cut (not shown).

Figure 8:
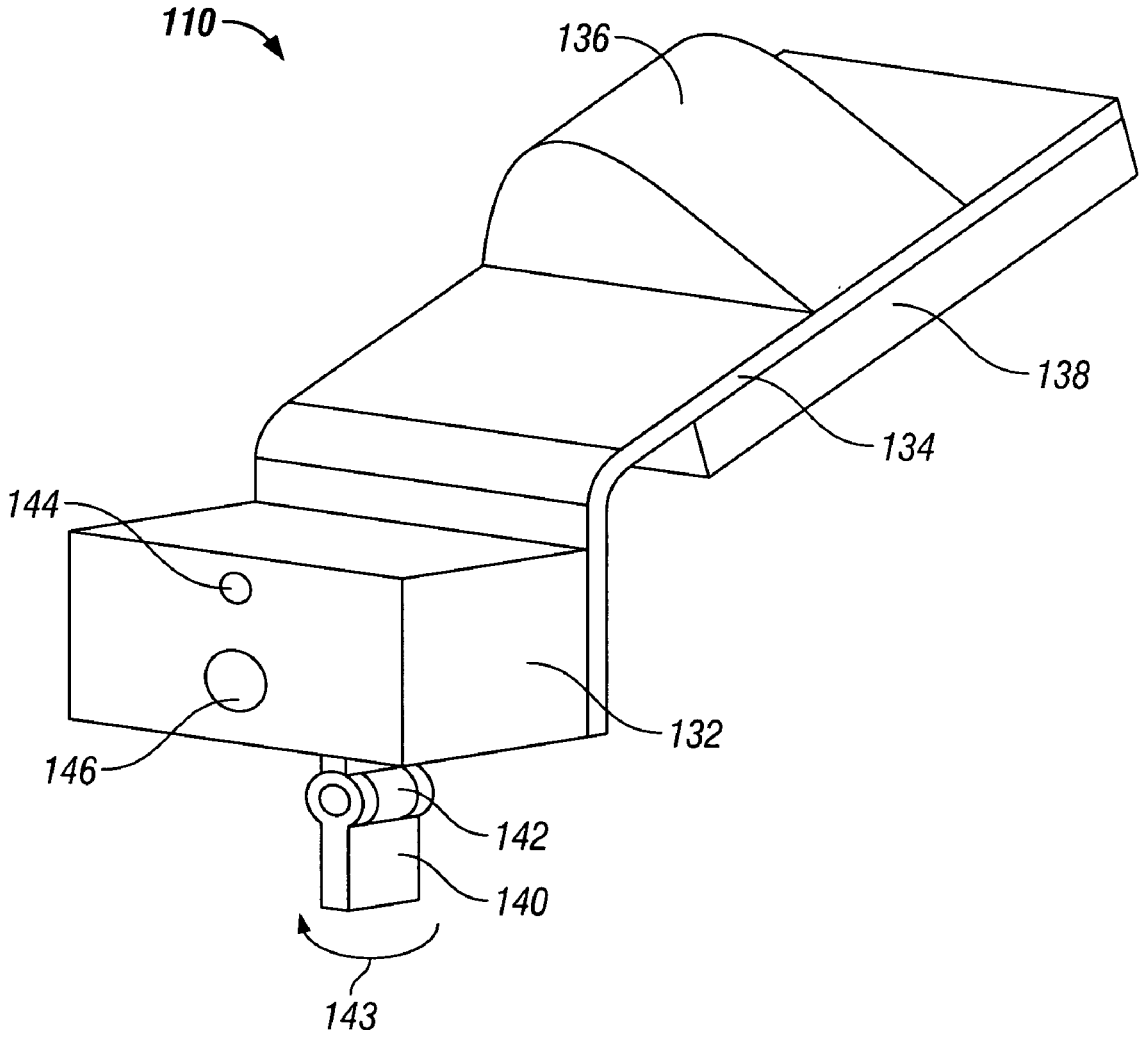
FIG. 8 is a perspective view of one of the right actuators of FIG. 2.

The actuators will now be considered in more detail. As shown in FIG. 8, each of the right actuators 110, 112 has a base 132 coupled to a frame 134. A cam 136 is coupled to a middle section of the frame 134. Additionally a plate 138 with a soft material is coupled to the frame 134. An actuating arm 140 is attached on a bottom side of the base 132 through a torsional spring hinge 142. The spring hinge 142 allows the actuating arm 140 to rotate only in a clockwise direction as indicated by the arrow 143 in FIG. 8.

When the belt 102 rotates in either direction, the actuating arm 140 contacts the right limiting switch 98. The hinge 142 only allows for activation of the left limiting switch 100 if the belt 102 is rotating in a counterclockwise direction. When the belt 102 rotates clockwise, the actuating arm 140 rotates clockwise about the spring hinge 142 and does not activate the switch 98.

Figure 9:
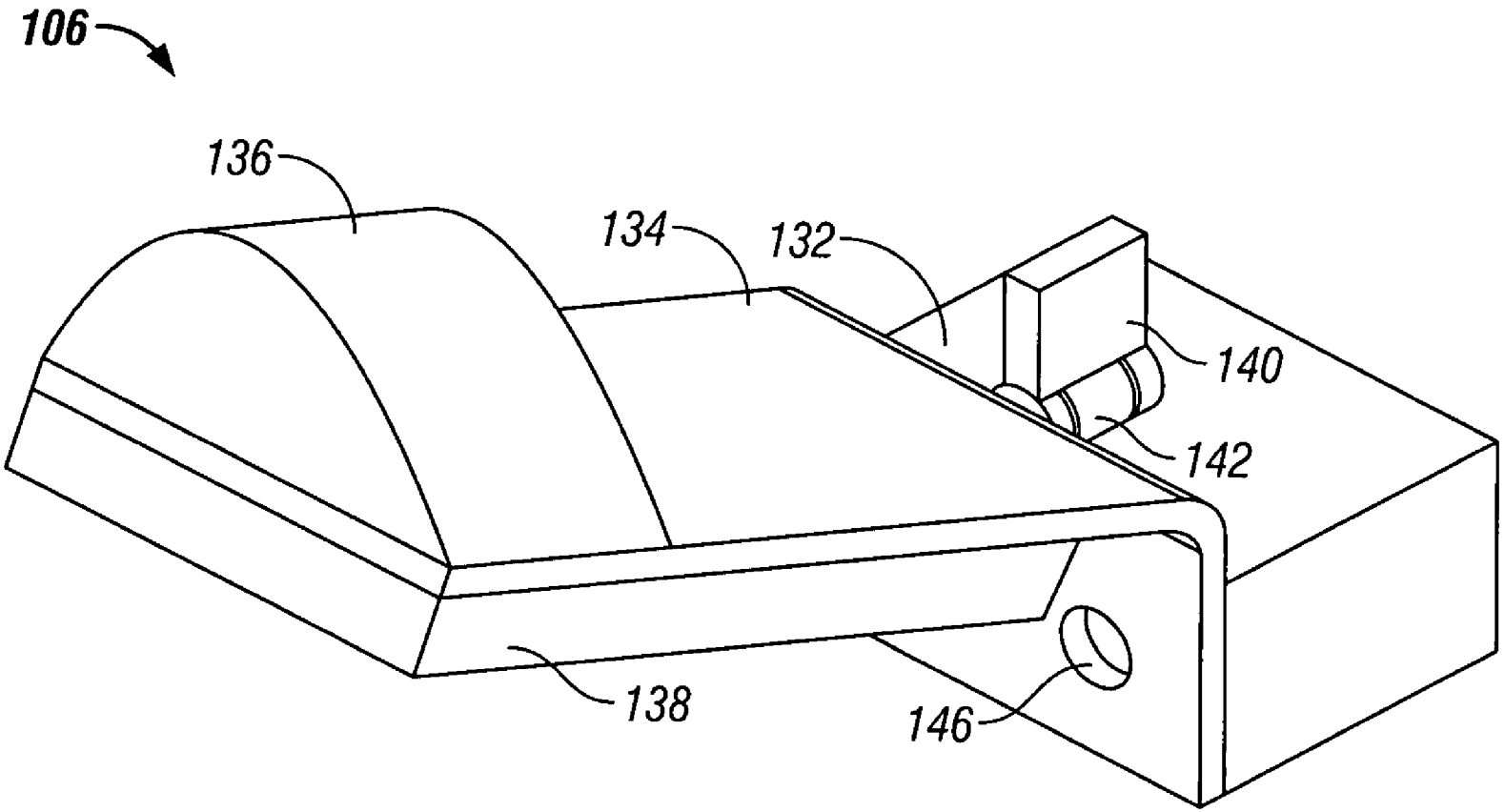
FIG. 9 is a perspective view of one of the left actuators of FIG. 2.

As shown in FIG. 9, the left actuators 106, 108 have a similar configuration to the right actuators 110, 112 except the actuating arm 140 and the torsional spring hinge 142 are located on an upper surface of the base 132. Additionally, the cam 136 is located at a distal end of the frame 134. The spring hinge 142 allows the actuating arm 140 to rotate only in a clockwise direction.

When the belt 102 rotates in either direction, the actuating arm 140 contacts the right limiting switch 100 and only actuates the right limiting switch 100 in the clockwise rotation of the belt 102. When the belt 102 rotates counter-clockwise, the actuating arm 140 rotates clockwise about the spring hinge 142 and does not activate the switch 98.

The bases of the actuators are coupled to the timing belt 102. In one embodiment, as shown in FIGS. 8 and 9, each base 132 has a pinhole 144 and a threaded hole 146. A pin (not shown) and a screw (not shown) are inserted through the belt 102 and into the pinhole 144 and the threaded hole 146 to secure the base 132 to the belt 102.

Figure 10:
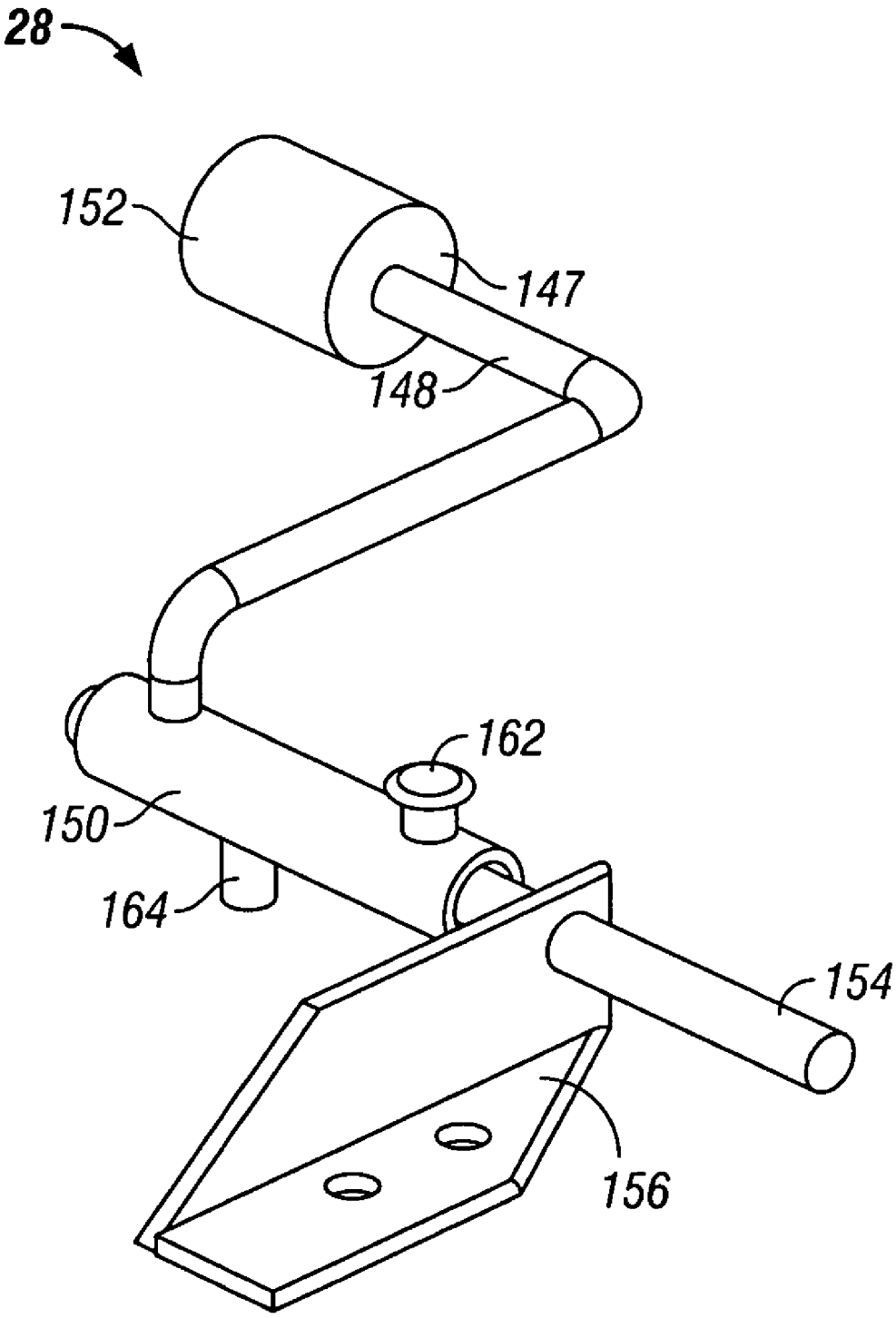
FIG. 10 is a perspective view of one of the pickup arms of FIG. 2.

As shown in FIG. 10, the right pickup arm 28 comprises a cylindrical roller 147 rotatably mounted to an L-shaped arm 148, which is coupled to a cylinder 150. A surface 152 of the roller 147 is covered with an adhesive. A rigid bar 154 is located coaxially inside the cylinder 150 and provides a bearing for the cylinder 150. The bar 154 is rigidly connected to a base bracket 156. As shown in FIG. 2, the base bracket 156 is rigidly connected to a guide plate 158 using a fastener known in the art, such as a screw 160. The guide plate 158 is connected to the support 36.

As shown in FIG. 10, a torsional spring (not shown) is coaxially located around the bar 154 and is secured between a pin 162 connected to the cylinder 150 and the base bracket 156. The biased spring applies a bias torque to the L-shaped arm 148 and keeps the arm in a neutral horizontal position. A follower pin 164 is rigidly attached to the cylinder 150 at a location such that it only engages the cam 136 of one of the right actuators 110, 112.

When one of the right actuators 110 moves under the right pickup arm 28, from the right to the left, the pin 164 moves over the cam 136 and causes the arm 148 to turn to the right (clockwise) and the roller 147 and the adhesive on the surface 152 of the roller come in contact with a book page 39. Once the right actuator 110 passes the pin 164, the biased spring turns the arm 148 (counterclockwise) and the book page 39 is lifted. Although a roller with an adhesive is used in the exemplary embodiment of the present invention illustrated herein, the roller can be replaced with another lifting device known in the art, such as a suction cup where a pneumatic negative pressure will lift the page.

The left pickup arm 30 is a mirror image of the right pickup arm 28 except that the pin 164 is located so that the pin 164 only comes in contact with the cam 64 of one of the left actuators 106, 108. It will be appreciated by those skilled in the art that the L-shaped arm 148 does not necessarily have to be L-shaped, but rather may be otherwise bent, curved, or angled such that the roller 147 is placed in contact with a book page 39 upon rotation of the arm 148.

To constrain the fingers 104 and the actuators 106, 108, 110 and 112 with respect to the timing belt 102 and the book 26, two guide rails 166, 168 are attached to the guide plate 158 and the support 36, as shown in FIG. 6. The two guide rails 166, 168 are separated to create a slot 170, which has the same height as the finger base 128 and the actuator base 132. The timing belt 102, which is flexible in the region between the pulley 120 and the sprocket 96, is also restrained by passage through a belt slot (not shown) on the guide plate 158. When the sprocket 96 is turned, the finger bases 128 and the actuator bases 132 pass through the slot 170. Optionally, both ends of the slot 170, the edges of the finger bases 128, and the edges of the actuator bases 132 can be rounded to minimize the friction as the fingers and actuators enter into and exit from the slot 170. Optionally, the tolerance of the slot 170 can be tighter at both of its ends than at its midsection to further reduce friction.

As shown in FIG. 1, an on/off switch 172, located on the cover 38, energizes the page turner 20 through an electric cord 174 electrically coupled to a conventional electrical outlet. In an additional embodiment, the page turner 20 is a portable cordless apparatus in which a set of batteries are used to energize the page turner 20.

Upon manually pressing a forward button 178 located on the cover 38, the motor 90 is energized. Once energized, the motor 90, in conjunction with the gear reducer train 92 and the clutch 94, rotates the sprocket 96 and the timing belt 102 in a counterclockwise direction to turn the page 39 from right to left (forward).

Similarly, upon pressing a reverse button 180 located on the cover 38 the motor 90 is energized. Once energized the motor 90, in conjunction with the gear reducer train 92 and the clutch 94, rotates the sprocket 96 in a clockwise direction to turn the page 39 from left to right (reverse).

Instead of the on/off, forward, and reverse buttons located on the casing, other triggers may be employed. Alternative triggers including, but not limited to, foot pedals, breath-controlled switches, chin switches, voice activation devices, or computerized timers, can be used to energize the motor 30 in either forward or reverse directions. The clutch 94 is a safety clutch that limits the maximum torque for the shaft over which the sprocket's shaft turns idle.

Operation of the page turner 20 according to one embodiment of the present invention will now be considered in more detail. First, the book is restrained in the book support assembly 24. The length of the spines 40 is adjusted by sliding the upper and lower members 42, 44 of each spine to the height of the book. The length of the spines 40 is then fixed using the pinholes 46 and set screws 48. The two sides of the book 26 are placed on the two spines 40. Clips 54 are used to restrain the top and the bottom of each sides of the book, leaving only about 50 loose (floating) pages on each side of the book. More or less pages can be left loose depending on how fast and how long a user intends to read.

Once the book 26 is restrained in the book support assembly 24, the book support assembly is connected to the frame 22 through the book support bracket 66. The springs 76 of the two brackets 66 exert an upward force on the book, thereby pushing the loose pages against the fingers 104.

FIG. 7 shows the rest positions of the left actuators 106, 108 and the right actuators 110, 112. The actuators are located symmetrically with respect to a center of the belt 102. There are several fingers 104 attached to the timing belt 102. The fingers 104 are equally spaced over the regions of the belt, located between adjacent pairs of actuators. The number of fingers may be altered depending on the size of the book and the page turner.

In an exemplary embodiment, there are a total of eight fingers and four actuators. To explain the process of turning a page, the fingers and actuators are numbered 201 to 212, as shown in FIG. 7. The sequence of operation for turning a page forward is shown in steps I to IV in FIG. 11A, and in steps V to VIII in FIG. 11B.

Figure 11A:
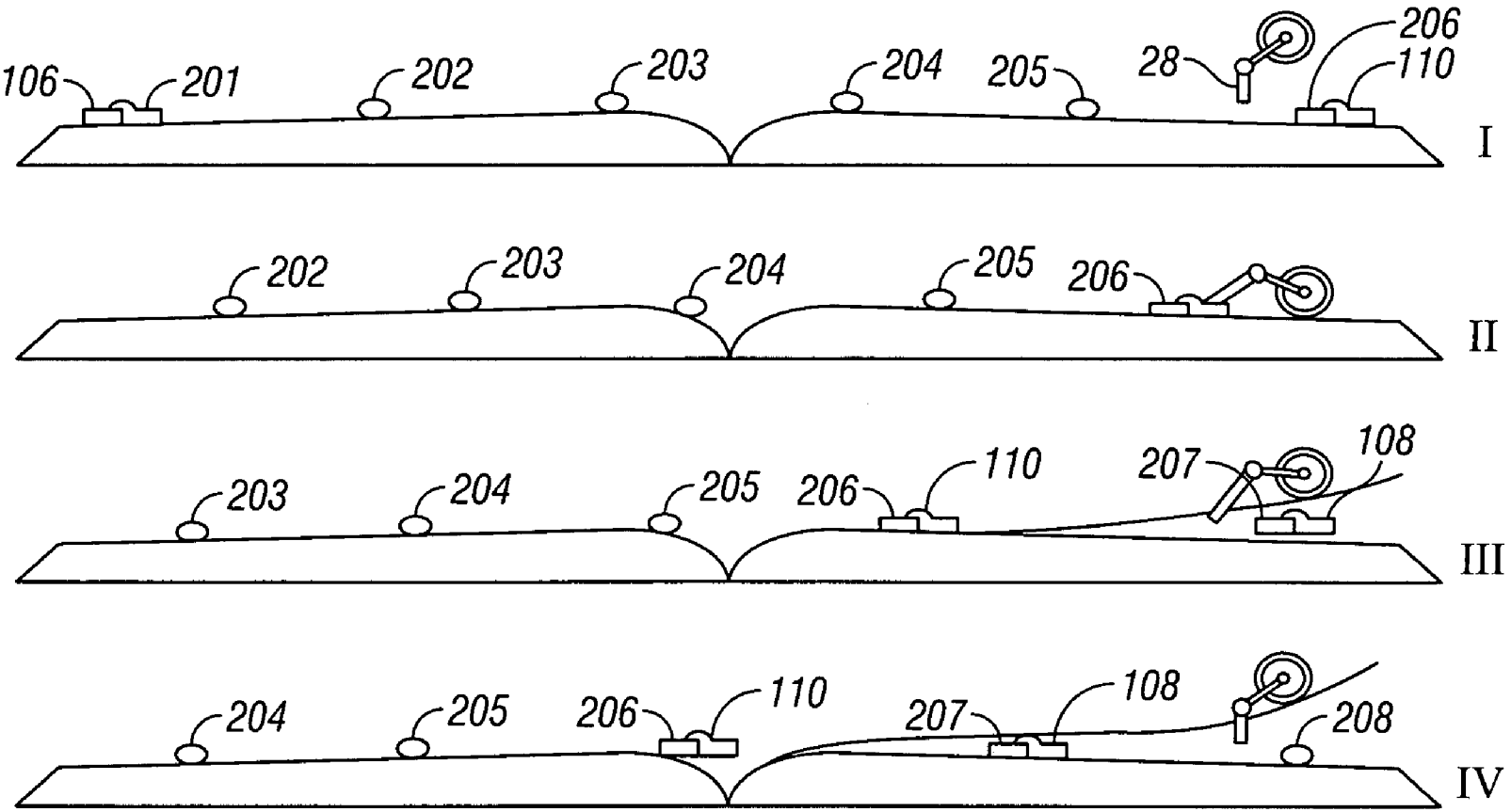
FIG. 11A is a schematic view depicting a first portion of the page turning process.

The rest position of the fingers and the right pickup arm 28 is depicted in section I of FIG. 11A. When the motor 90 is energized in a forward direction, the belt 102 rotates counterclockwise and one of the right actuators 110 (labeled as number 206 in FIGS. 7 and 11A) moves from the right side toward the left side. As the belt 102 rotates, the fingers 104 (labeled as numbers 202 to 205) roll across the pages 39 of the book 26 to the left, and the cam 136 of the right actuator 206 comes in contact with the pin 164 of the right pickup arm 28.

As the cam 136 pushes against the pin 164, the arm 28 turns clockwise (downward) so that the roller 147 and the adhesive on the surface 152 adhere to the book page 39, as shown in section II of FIG. 11A. Once the cam 136 has passed under the pin 164, the spring (not shown) turns the arm 148 counterclockwise to its original upward position. This creates a curl and lifts the page 39 upward, as shown in section III of FIG. 11A.

As the belt 102 continues to rotate counterclockwise, the contacting fingers 104 (labeled as numbers 203, 204, and 205) continue to roll to the left over the pages 39 of the book 26, and the adjacent actuator, a left actuator 108 (labeled as 207), moves under the curled page 39. The left actuator carries the page 39 over to the left side while an additional finger 104 (labeled as 208) rolls over a new page and under the old page, as shown in section IV of FIG. 11A.

Figure 11B:
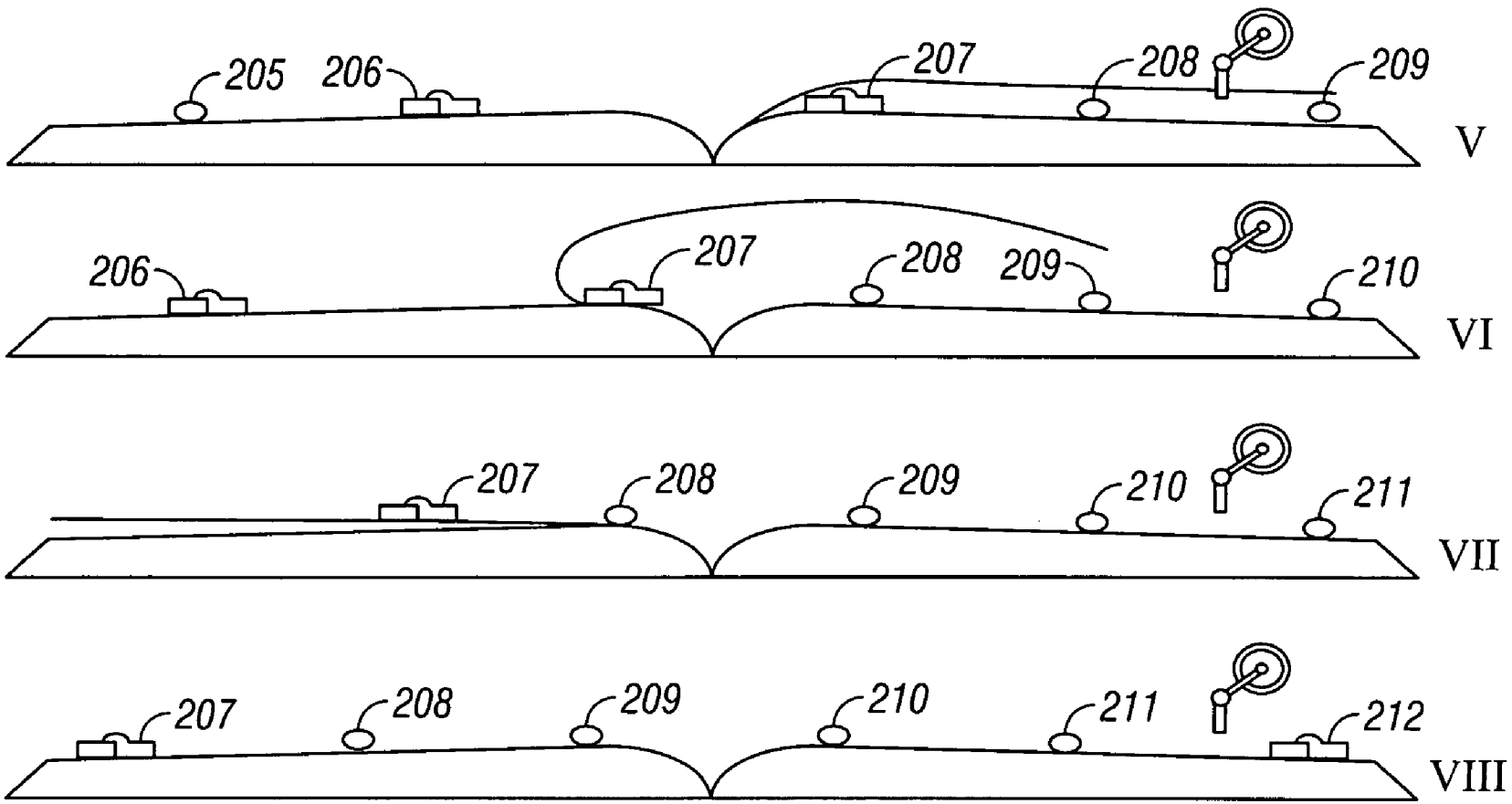
FIG. 11B is a schematic view depicting a second portion of the page turning process.

As shown in sections V and VI of FIG. 11B, the rotation of the belt 102 and the leftward movement of the fingers continues and the page is carried to the left. The rotation of the belt 102 stops when the right actuator 206 reaches a location where the actuating arm 140 contacts the right limiting switch 98 thereby disconnecting power to the motor 90, as shown in section VII of FIG. 11B. As the motor 90 stops, the left actuator 207, reaches a leftmost position, and the forward cycle is completed, as shown in section VIII of FIG. 11B.

In the reverse direction, an example of which will be considered in conjunction with the numbering shown in FIG. 7, the motor 90 rotates the belt 102 in the clockwise direction and moves the left actuator 106 (labeled as 201 in FIG. 7) located at the left side of the book to the right side of the book. As the cam 136 of the left actuator 201 moves under the pin 164 of the left pickup arm 30, the arm 148 rotates such that the roller 147 and the adhesive on the surface 152 of the roller contacts the book page 39. As in the forward cycle, once the cam 136 has passed under the pin 164, the spring (not shown) turns the arm 148 clockwise to its original upward position to lift up the page 39.

The belt 102 continues to rotate clockwise and the adjacent right actuator 112 (labeled as 212 in FIG. 7) moves under the page 39. The right actuator 212 carries the page 39 over to the right side while additional fingers 104 (labeled as 211, 210, 209, and 208 in FIG. 7) roll over the new page. The movement of the belt 102 stops when the left actuator 201 reaches a location where the actuating arm 140 contacts the left limiting switch 100 and disconnects the power to the motor 90. In this position the right actuator 212 reaches to a rightmost point and the reverse cycle is completed.

As will be appreciated by those skilled in the art, in moving a page either forward or backward, the belt 102 is rotated 180 degrees, thereby switching the locations of the actuators. The location and orientation of the left actuators 106, 108 and the right actuators 110, 112 are such that the lifting and the transport of the page is initiated as soon as the motor 90 is energized, without any delays for resetting the position of the right and left pickup arms 28, 30.

The length of the fingers 104 and the actuators 106, 108, 110, 112 are such that they are located in the bottom margin of the book and do not interfere with the text of the book. The length of the arm 148 of each pickup arm 28, 30 is such that it extends to about ⅔ of the page width, where there is a sufficient lifting force. The use of different adhesives allows for the arm 148 to be extended either more or less and still generate sufficient lifting force.

Depending on the size of the book and usage location of the page turner 20, the page turner 20 can be rested on a horizontal base 182 of the cover 38 so that the book has about a 30 degree angle with respect to the ground when mounted on the page turner 20. Alternatively, the page turner could be rested on an oblique surface 184 of the cover 38 where the angle of the book will be about 75 degrees with respect to the ground when mounted on the page turner 20.

Although the present invention has been described in considerable detail with reference to certain preferred versions thereof, other versions are possible. Therefore, the spirit and scope of the appended claims should not be limited to the description of the preferred versions described herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means" or "step" clause as specified in 35 U.S.C. § 112.

What is claimed is:

1. An apparatus for turning bound pages, the apparatus comprising:
- a frame;
- a support assembly coupled to the frame;
- at least one pickup arm coupled to the frame;
- a motor assembly coupled to the frame; and
- a conveyor assembly coupled to the motor assembly, the conveyor assembly further comprising:
  - a belt;
  - a plurality of fingers coupled to the belt; and
  - at least one actuator coupled to the belt;
- wherein a subset of the plurality of fingers holds the bound pages in an open condition; and
- wherein upon rotation of the belt by the motor assembly the at least one actuator causes the at least one pickup arm to lift a portion of a page and at least one of the plurality of fingers turns the lifted page while another of the plurality of fingers holds the bound pages in an open condition.

2. The apparatus for turning bound pages of claim 1 wherein the motor assembly further comprises:
- a motor;
- a gear reduction train coupled to the motor;
- a clutch coupled to the gear reduction train; and
- a sprocket coupled to the clutch, the sprocket being connectable to the belt.

3. The apparatus for turning bound pages of claim 2 wherein the motor is reversible.

4. The apparatus for turning bound pages of claim 2 further comprising at least one button electrically coupled to the motor for energizing the motor.

5. The apparatus for turning bound pages of claim 2 further comprising at least one of a foot pedal, a breath-controlled switch, a chin switch, a voice activation device, and a computerized timer electrically coupled to the motor for energizing the motor.

6. The apparatus for turning bound pages of claim 1 wherein the support assembly further comprises:
- two expandable spines, each spine having a proximal end and a distal end;
- a plurality of crossbar supports, one of the plurality of crossbar supports being mounted on each end of the spines;
- a plurality of clamps, one of the plurality of clamps being mounted on each crossbar support by a spring hinge, the spring hinge providing a bias force on the bound pages.

7. The apparatus for turning bound pages of claim 6 wherein each spine is attached to the frame by a mounting bracket, the mounting bracket further comprising:
- a bracket frame;
- a base having two vertical cylindrical cavities, and an angled cylindrical cavity coupleable to the proximal end of one of the spines;

a center tube coupled to the bracket frame having an inner rod;

a bias spring located coaxially around the inner rod of the center tube; and two guiding rods, the guiding rods being coupled to the bracket frame and insertable in the two vertical cylindrical cavities of the base;

wherein the base is moveable along the two guiding rods to generate a reaction bias force in the bias spring.

8. The apparatus for turning bound pages of claim 1 wherein the conveyor assembly further comprises:

two right actuators coupled to the belt; and two left actuators coupled to the belt.

9. The apparatus for turning bound pages of claim 1 wherein each of the plurality of fingers further comprises:

a base;

an arm coupled to the base; and a roller coupled to the arm.

10. The apparatus for turning bound pages of claim 1 wherein the at least one actuator further comprises:

a base coupled to the belt;

an actuator frame coupled to the base;

a cam coupled to the actuator frame; and a switch trigger coupled to the base;

wherein the switch trigger on the actuator is only rotatable in one direction.

11. The apparatus for turning bound pages of claim 1 wherein the at least one pickup arm further comprises:

a bracket mountable to the frame;

a shaft mounted to the bracket;

an arm coupled to the shaft, the arm having a proximal end and a distal end, the arm being bent, curved or angled;

a roller rotatably coupled to the distal end of the arm, the surface of the roller being covered with an adhesive;

a torsional spring coupled to the shaft, the torsional spring applying a bias torque to the arm and thereby maintaining the arm in a neutral position; and a follower pin coupled to the shaft, the follower pin impacting the at least one actuator to rotate the arm and place the roller in contact with the page of the book;

wherein upon release of the follower pin by the at least one actuator, the spring provides a bias torque and lifts the arm.

12. A method for turning bound pages comprising:

selecting the apparatus of claim 1;

placing bound pages in the support assembly; and energizing the motor assembly to turn at least one of the bound pages.

13. An apparatus for turning bound pages, the apparatus comprising:

a frame;

a book support assembly coupled to the frame;

a left pickup arm coupled to the frame;

a right pickup arm coupled to the frame;

a motor assembly coupled to the frame, the motor assembly having a reversible motor; and a conveyor assembly coupled to the motor assembly, the conveyor assembly further comprising:

a belt;

a plurality of fingers coupled to the belt; and two left actuators coupled to the belt;

two right actuators coupled to the belt;

wherein a subset of the plurality of fingers hold the bound pages in an open condition;

wherein each of the two right actuators causes the right pickup arm to lift a portion of a right page upon counterclockwise rotation of the belt by the motor assembly;

wherein each of the two left actuators cause the left pickup arm to lift a portion of a left page upon clockwise rotation of the belt by the motor assembly;

wherein the plurality of fingers turn the lifted right page upon counterclockwise rotation of the belt by the motor assembly; and wherein the plurality of fingers turn the lifted left page upon clockwise rotation of the belt by the motor assembly.

14. An apparatus for turning bound pages, the apparatus comprising:

a frame;

a support assembly coupled to the frame;

a means for lifting a page, the means for lifting a page being coupled to the frame;

a motor assembly coupled to the frame; and a conveyor assembly coupled to the motor assembly, the conveyor assembly further comprising:

a belt;

a plurality of fingers coupled to the belt; and at least one actuator coupled to the belt;

wherein a subset of the plurality of fingers holds the bound pages in an open condition; and wherein upon rotation of the belt by the motor assembly the at least one actuator causes the means for lifting a page to lift a portion of a page and at least one of the plurality of fingers turns the lifted page.

* * * * *